US007024884B2

(12) United States Patent
Kent et al.

(10) Patent No.: US 7,024,884 B2
(45) Date of Patent: Apr. 11, 2006

(54) CONDENSER FOR AN AIR CONDITIONING SYSTEM

(75) Inventors: Scott Edward Kent, Albion, NY (US); David A. Southwick, Lockport, NY (US); Maciej Kozikowski, Ostrow WLKP (PL); Krzysztof Wawrocki, Ostrow WLKP. (PL); Christopher Alfred Fuller, Buffalo, NY (US)

(73) Assignee: Delphi Technologies, Inc., Troy, MI (US)

( * ) Notice: Subject to any disclaimer, the term of this patent is extended or adjusted under 35 U.S.C. 154(b) by 104 days.

(21) Appl. No.: 10/861,873

(22) Filed: Jun. 3, 2004

(65) Prior Publication Data

US 2005/0268645 A1 Dec. 8, 2005

(51) Int. Cl.
*F25B 43/00* (2006.01)

(52) U.S. Cl. ..... 62/509; 62/474

(58) Field of Classification Search ..... 62/507, 62/509, 474; 165/67, 140, 149
See application file for complete search history.

(56) References Cited

U.S. PATENT DOCUMENTS

| | | | | |
|---|---|---|---|---|
| 5,546,761 | A * | 8/1996 | Matsuo et al. | 62/509 |
| 5,713,217 | A | 2/1998 | Baba | 62/509 |
| 6,334,333 | B1 | 1/2002 | Shinhama | 62/509 |
| 6,470,704 | B1 | 10/2002 | Shibata et al. | 62/509 |
| 6,505,481 | B1 | 1/2003 | Neumann et al. | 62/506 |
| 6,578,371 | B1 | 6/2003 | Beasley et al. | 62/77 |
| 6,705,387 | B1 * | 3/2004 | Kokubunji et al. | 165/67 |
| 2003/0085026 | A1 | 5/2003 | Kaspar | 165/132 |

* cited by examiner

*Primary Examiner*—Melvin Jones
(74) *Attorney, Agent, or Firm*—Patrick M. Griffin

(57) ABSTRACT

A condenser for an air conditioning system includes a core assembly having a header tank and a receiver/dehydrator member operably connected to the core assembly for condensing a refrigerant flowing internally. The receiver/dehydrator or receiver member includes two openings to receive male couplers extending from a tubular member connected to the core assembly. The condenser includes a coupler that extends into the receiver/dehydrator member between each opening and the male couplers to form a seal therebetween. The coupler and the male coupler are connected one with the other by brazing. In an alternative embodiment, the male coupler includes a snap-in element to engage the male coupler with the coupler.

20 Claims, 10 Drawing Sheets

CONDENSER FOR AN AIR CONDITIONING SYSTEM

BACKGROUND OF THE INVENTION

1. Field of the Invention

The subject invention relates to a heat exchanger, and more particularly, to a condenser having a receiver/dehydrator assembly for an air conditioning system for a vehicle.

2. Description of the Prior Art

Modern vehicles are designed to provide passengers with comfort, convenience, and safety. One comfort system that few could live without is an air conditioning system. The air conditioning system used in the modem vehicles is designed to cool, dehumidify, clean, and circulate the air in a vehicle. The air conditioning system presents a closed, pressurized system that has a compressor, a condenser, a receiver/dehydrator (R/D), an expansion valve or orifice tube and a plurality of additional components used in combination therewith to increase efficiency and dependability of the air conditioning system.

The compressor is a heart of the air conditioning system and is designed to separate high-pressure and low-pressure sides of the air conditioning system and includes outlet and inlet portions. The primary purpose of the compressor is to draw the low-pressure and low-temperature vapor from the evaporator and compress this vapor into high-temperature, high-pressure vapor. The secondary purpose of the compressor is to circulate or pump a refrigerant through the air conditioning system under the different pressures required for proper operation of the air conditioning system. The compressor is located in an engine compartment and is driven by the engine's crankshaft via a drive belt.

The condenser includes coiled refrigerant tubing mounted in a series of thin cooling fins to provide maximum heat transfer in a minimum amount of space. The purpose of the condenser is to condense or liquefy the high-pressure, high-temperature vapor coming from the compressor. The condenser is operably connected to the R/D.

The R/D includes first and second tanks or housings. The R/D functions as a storage tank for the liquid refrigerant, wherein the liquid refrigerant flows into the upper tank containing a bag of a moisture-absorbing material such as silica alumina, silica-gel, or the like. The bag is necessary to be present in the upper tank to absorb any moisture present therein that might enter the air conditioning system during assembly and to prevent damage to the compressor.

It is becoming more common for the air conditioning system to use condensers with an integrated R/D. Since the most optimum pressure vessel design is a circular cross section, the upper and lower tanks having circular cross section must be joined to preserve the pressure inside the upper and lower tanks. Many different means have been used to integrate the upper and lower tanks to the R/D of the condenser. The art is replete with various designs of condenser showing integral R/D's. These designs are disclosed in the U.S. Pat. Nos. 5,546,761 to Matsuo et al.; 5,713,217 to Baba; 6,334,333 to Shinhama; 6,470,704 to Shibata et al.; 6,505,481 to Neumann et al., 6,578,371 to Beasley et al.; and the U.S. Patent Application Publication No. 2003/0085026 to Kaspar et al.

Some of the aforementioned patents accomplish the joining through pipe and block or plate style refrigerant connectors. The U.S. Pat. No. 6,578,371 to Beasley et al., for example, teaches a condenser having upper and lower tanks and a mounting bracket operably connected to the lower tank. A pair of pipes are coupled to and extend from the lower tank. The pipes further extend through the mounting bracket to the upper tank and operably connected thereto. The pipes are coupled to the lower tank header of the condenser system prior to furnace brazing, and the upper tank is subsequently mounted to the mounting bracket.

The U.S. Pat. No. 6,334,333 to Shinhama teaches a condenser having an upper tank and a lower tank communicatively connected one with the other by a refrigerant passage of a connection member. The connection member presents a pair of saddles defined therein and having a surface complementary with the circumference of the upper and lower tanks to mimic the dual chamber design. This design requires extra extrusion and braze over large surface area sections, whereby the braze interface is less than ideal.

The most challenging aspect of the integrated design is the refrigerant communication between the condenser and the R/D, preservation of the pressure in the R/D, as well as prevention and elimination of the refrigerant leakage. There is a constant need in the area of an automotive industry for improvements in a condenser having an integrated R/D.

BRIEF SUMMARY OF INVENTION

A condenser for an air conditioning system includes a core assembly having first and second terminal ends for condensing a refrigerant flowing between the first and second terminal ends. A header tank presents internal communication with the first terminal end. A tubular member is operably connected to the second terminal end. A tubular member presents at least one male portion. A receiver member presents at least one female portion defining an alignment axis for mating with said male portion along the alignment axis. The condenser includes a coupler that extends into the receiver member and is disposed between the female and male portions. The coupler engages the male portion with the female portion to form a seal between the male and female portions and to prevent leakage of the refrigerant and to preserve a pressure inside the receiver member.

An advantage of the present invention is to provide a low mass alternative in the design of the condenser having an integrated receiver/dehydrator.

Another advantage of the present invention is to provide a condenser having a coupler to eliminate leakage of the refrigerant and preserve pressure in the receiver/dehydrator.

Still another advantage of the present invention is to provide a condenser having an integrated receiver/dehydrator to allow a technician to engage and disengage the condenser and the integrated receiver/dehydrator for servicing the same without destroying the condenser.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
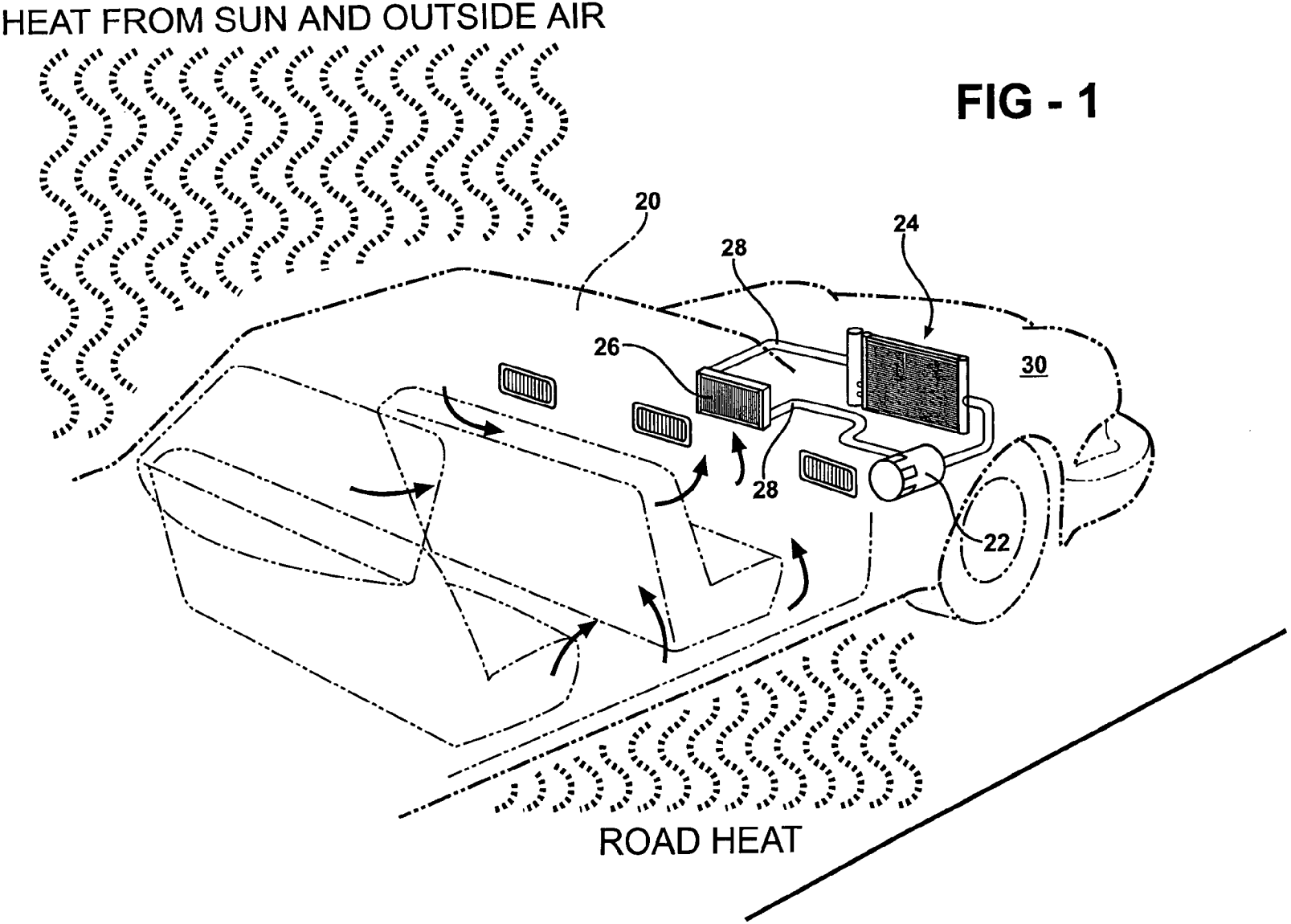
FIG. 1 is a perspective view of an air conditioning system and heat flow from inside a vehicle to outside.
Figure 2:
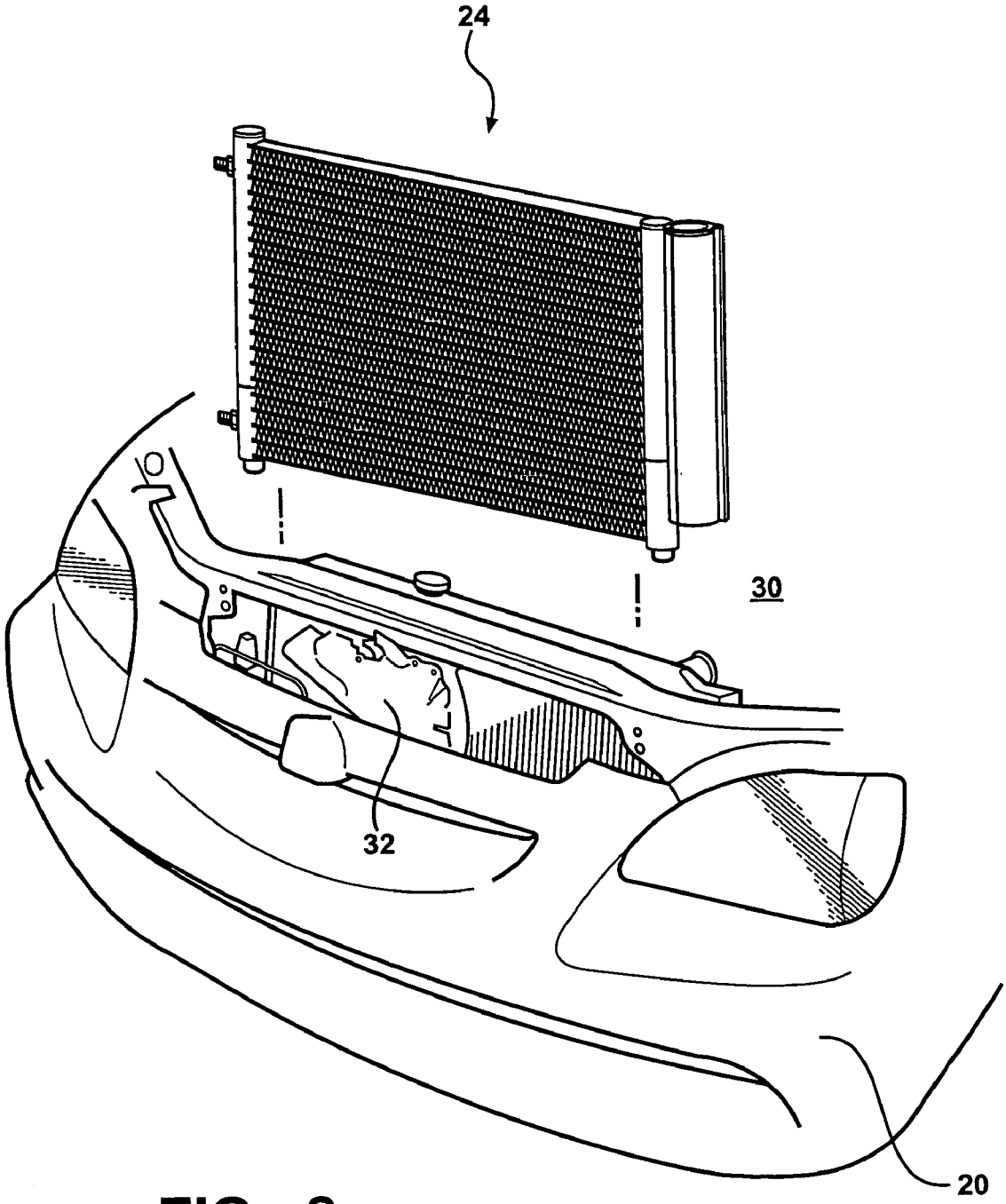
FIG. 2 is an exploded perspective view of a condenser mounted in front of a vehicle's radiator.

Referring to FIGS. 1 and 2, an air conditioning system for a vehicle 20 includes a compressor 22, operably connected a condenser 24, and an evaporator 26. All of the aforementioned components of a refrigerant cycle are serially connected by a metal pipe or a rubber pipe 28 to form a closed, pressurized system. The compressor 22 is operably connected to an engine (not shown), disposed within an engine compartment 30, through a belt and an electromagnetic clutch (not shown). The condenser 24 is cooled by air blown from a cooling fan 32.

Figure 3:
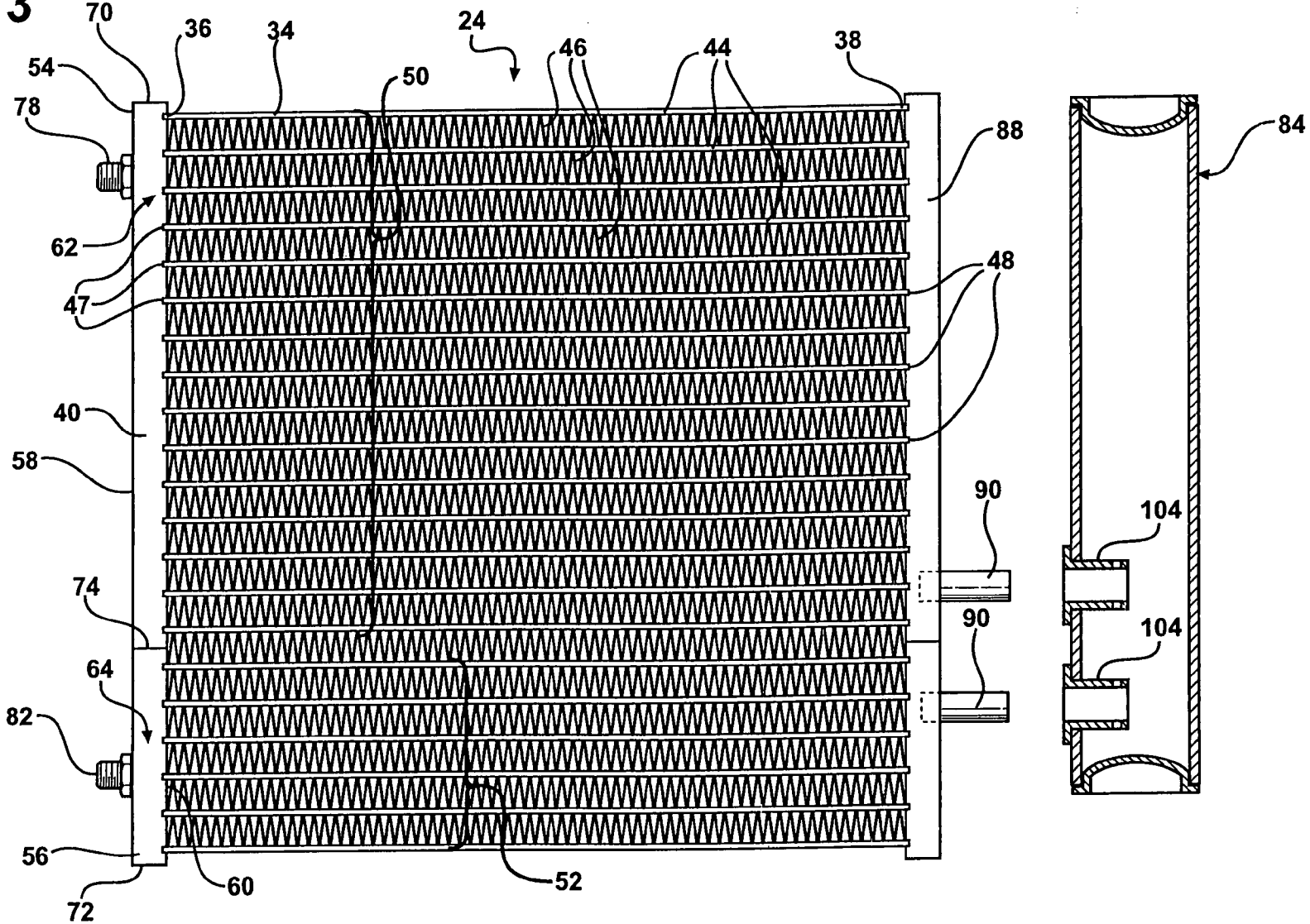
FIG. 3 is a partial cross sectional front view of the condenser with a receiver member spaced therefrom.
Figure 4:
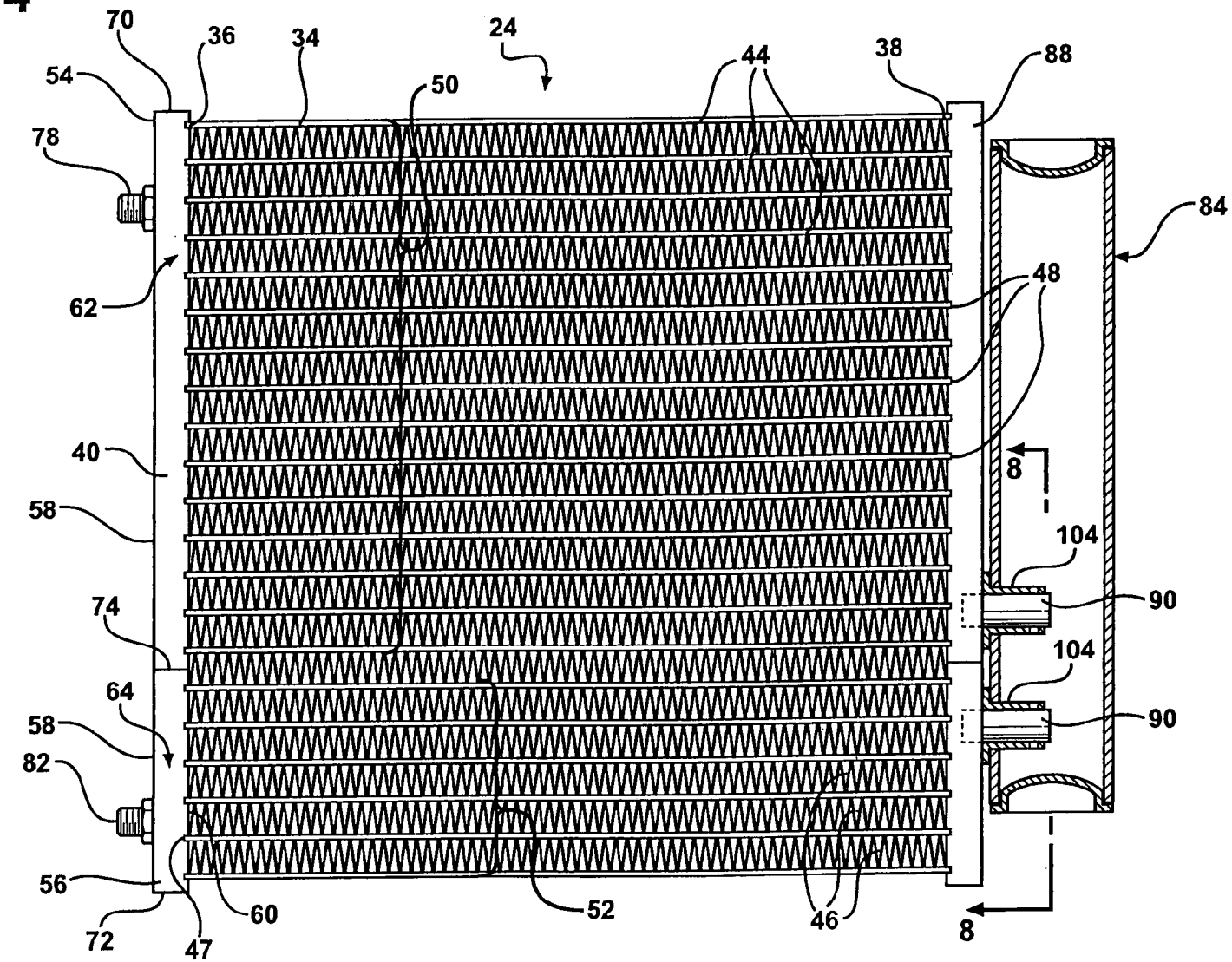
FIG. 4 is a partial cross sectional front view of the condenser, shown in FIG. 3, with the receiver member brazed thereto.
Figure 5:
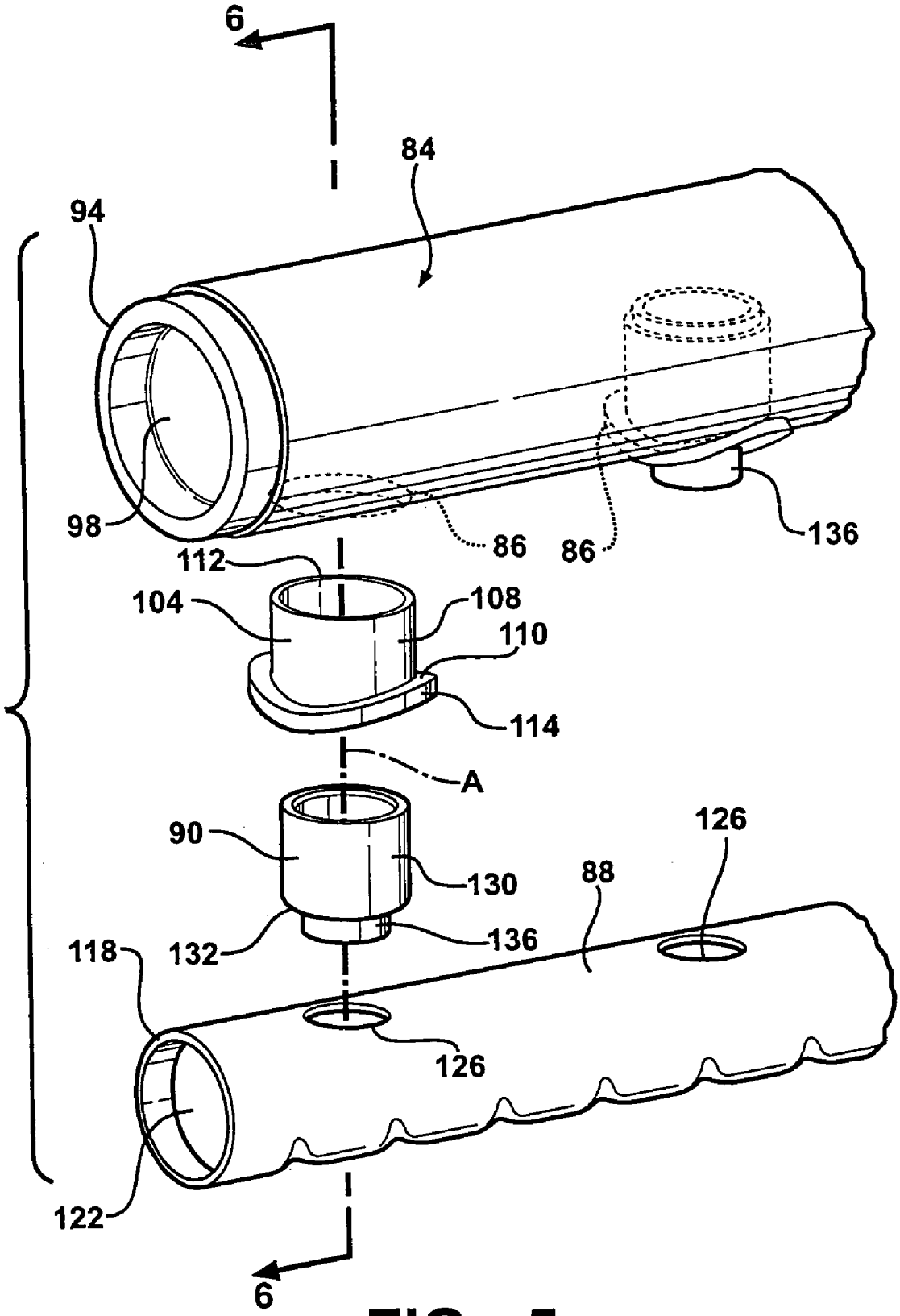
FIG. 5 is an exploded perspective view of a receiver member.
Figure 6:
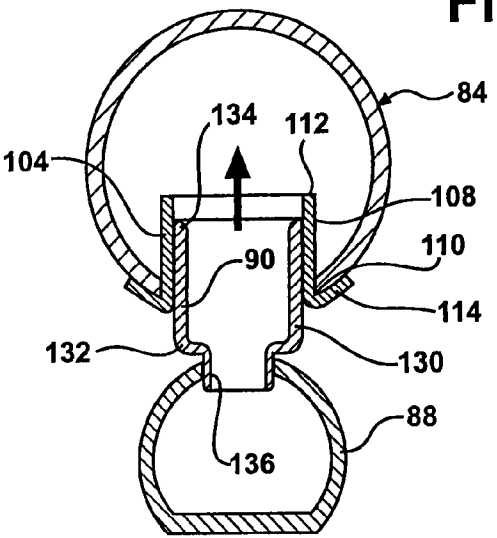
FIG. 6 is a cross sectional view of FIG. 5.

Referring now to FIGS. 3 and 4, the condenser 24 of the present invention includes a core assembly 34 having first 36 and second 38 terminal ends for condensing a refrigerant flowing internally. The core assembly 34 of the condenser 24 is disposed between a header tank 40 and a receiver member or receiver/dehydrator assembly, generally shown at 84. A plurality of tubes 44 through which the refrigerant flows horizontally are disposed between the header tank 40 and the receiver member 84. The core assembly 34 includes a plurality of corrugated fins 46. Each fin 46 is disposed between adjacent tubes 44. In each tube 44, a plurality refrigerant passages are formed. Each tube 44 includes first and second terminal ends 47, 48, wherein each terminal end 47, 48 is operably and fluidly connected with the header tank 40 and the receiver member 84, respectively. The tubes 44 are further divided into condensing, generally indicated at 50, and cooling, generally indicated at 52, tubes of the core assembly 34. The header tank 40 and the Receiver member 84 extend in a direction, i.e. vertical direction, perpendicular to the direction of the tubes 44. The number of the condensing tubes 50 is larger that of number of the cooling tubes 52.

The header tank 40 is operably connected to the first terminal end 36 of the core assembly 34. The header tank 40 includes terminal ends 54, 56, top 58 and bottom 60 sides, and upper and lower compartments, generally indicated at 62, 64, respectively. The header tank 40 includes a circular configuration, as viewed in cross section. The header tank 40 may be formed as a unitary piece or as a pair of plates (not shown), formed by press working a metal plate of aluminum or aluminum alloy and treated by cladding, to be discussed further below. The bottom side 60 of the upper compartment 62 of the header tank 40 is operably and fluidly connected with the terminal ends 48 of the condensing tubes 50. The bottom side 60 of the lower compartment 64 is operably and fluidly connected with the terminal ends 46 of the cooling tubes 52. The terminal ends 54, 56 of the header tank 40 are covered with caps 70, 72, respectively. The caps 70, 72 are formed into the circular shape, complementary to the circular configuration of the header tank 40, by press working an aluminum or aluminum alloy plate. The header tank 40 includes a separator wall 74, as shown in FIGS. 3 and 4, separating the upper 62 and lower 64 compartments. A refrigerant suction opening (not shown) is defined in the top side 58 on the upper compartment 62 of the header tank 40. The header tank 40 includes an inlet pipe 78 metalurgically connected thereto after brazing. A refrigerant discharge opening (not shown) is defined in the header tank 40 for fixing an outlet pipe 82 therein. The inlet 78 and outlet 82 pipes have a tubular configuration complementary to the configuration of the suction and discharge openings. The inlet 78 and outlet 82 pipes are joined to the refrigerant suction 76 and discharge 80 openings by brazing. While either brazing or other joining method may be employed, both being well known to those skilled in the art, brazing of the inlet 78 and outlet 82 pipes with the header tank 40 disclosed above, is not intended to limit the present invention. A tubular member 88 presents at least one male portion 90, i.e. male coupler, to mate with the opening 86 along the alignment axis A. The receiver member 84 extends in the direction parallel to the header tank 40. The receiver member 84 and the tubular member 88 include a circular configuration. Similar to the header tank 40, the receiver member 84 and the tubular member 88 may be formed as a unitary piece or as a pair of plates (not shown), formed by press working a metal plate of aluminum or aluminum alloy.

Referring to FIGS. 5 through 8, the receiver member 84 is operably connected to the second terminal end 38 of the core assembly 34, extending parallel to the header tank 40. The receiver member 84 presents a female portion 86 or opening, defined therein defining an alignment axis A. The receiver member 84 includes terminal ends 94, 96 and the openings 86 defined therein. The terminal ends 94, 96 of the receiver member 84 are covered with caps 98, 100, respectively. The caps 98, 100 of the receiver member 84 are formed into the circular shape, complementary to the circular configuration of the receiver member 84, by press working an aluminum or aluminum alloy plate. The receiver member 84, functions as a gas-liquid separating means which separates the refrigerant flowed therein from the core assembly 34 into gas and liquid refrigerants, respectively, and supplies only the liquid refrigerant to the cooling tubes 52 for cooling the liquid refrigerant flowed therein from the receiver member 84 by exchanging the heat of the liquid refrigerant with the fresh air delivered by the cooling fan 32 and other means known in the art.

Figure 7:
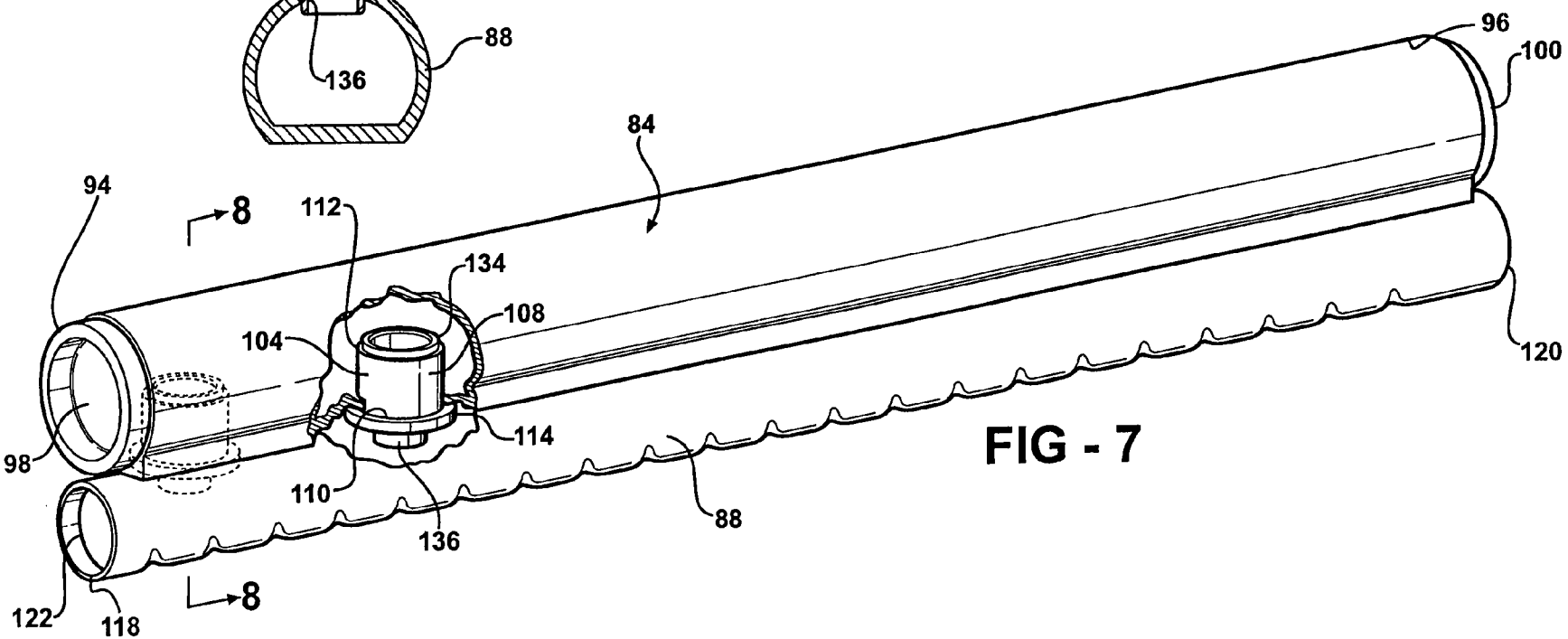
FIG. 7 is a perspective partially broken view of the receiver member mechanically interconnected with the tubular member by brazing.
Figure 8:
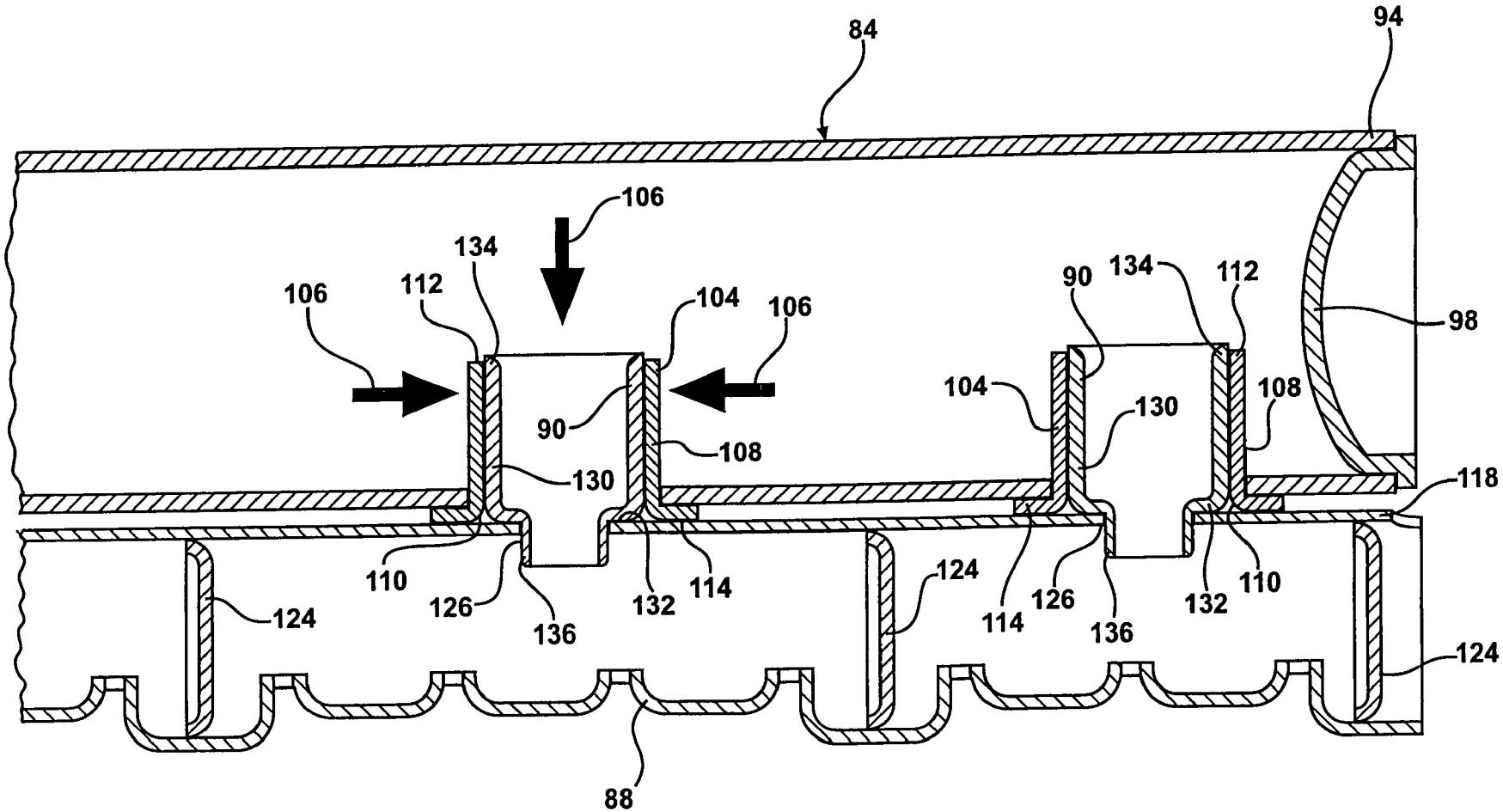
FIG. 8 is a perspective partially broken view of the receiver member mechanically interconnected with the tubular member by brazing.
Figure 9:
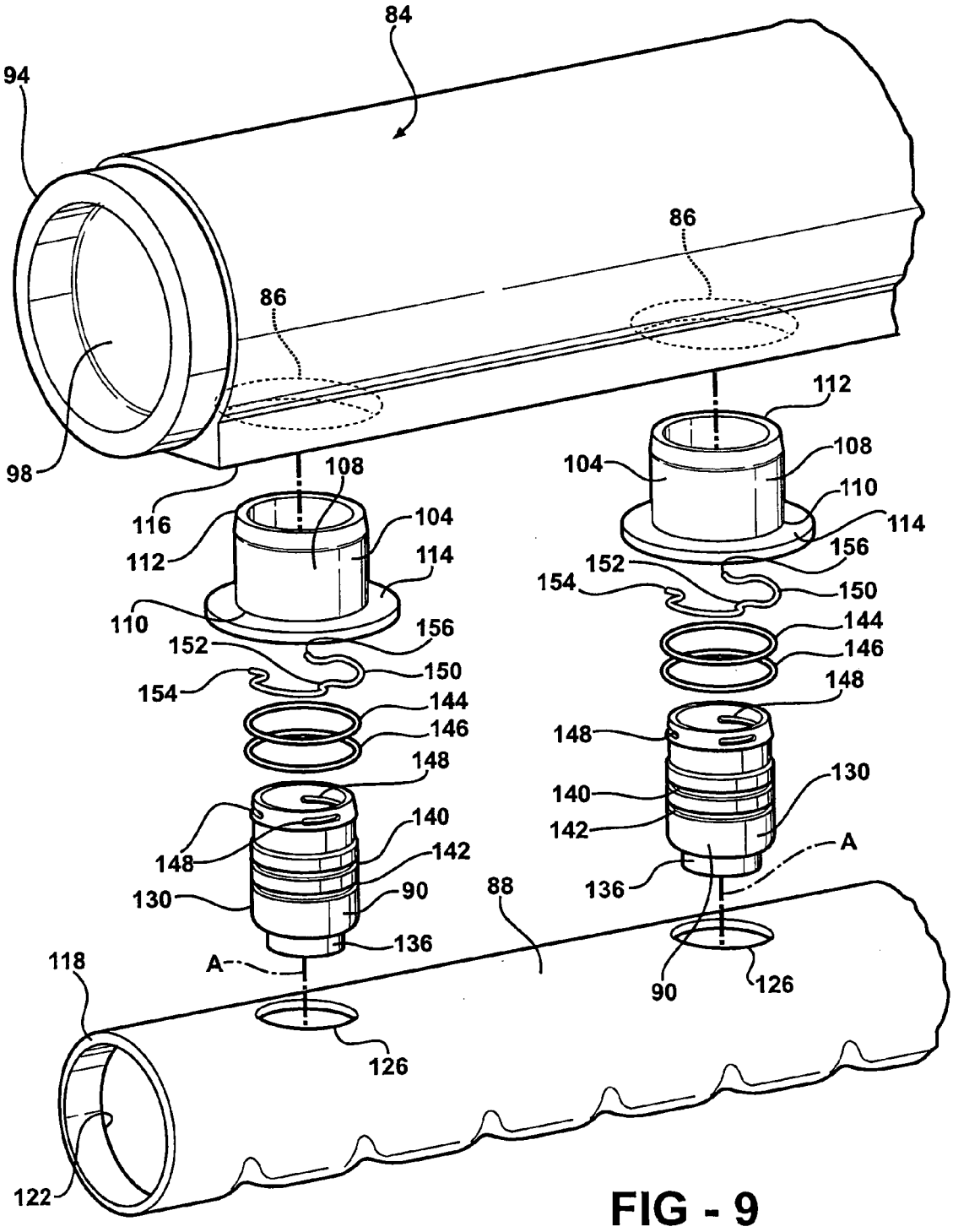
FIG. 9 is an exploded fragmental view of an alternative embodiment of the receiver member.
Figure 10:
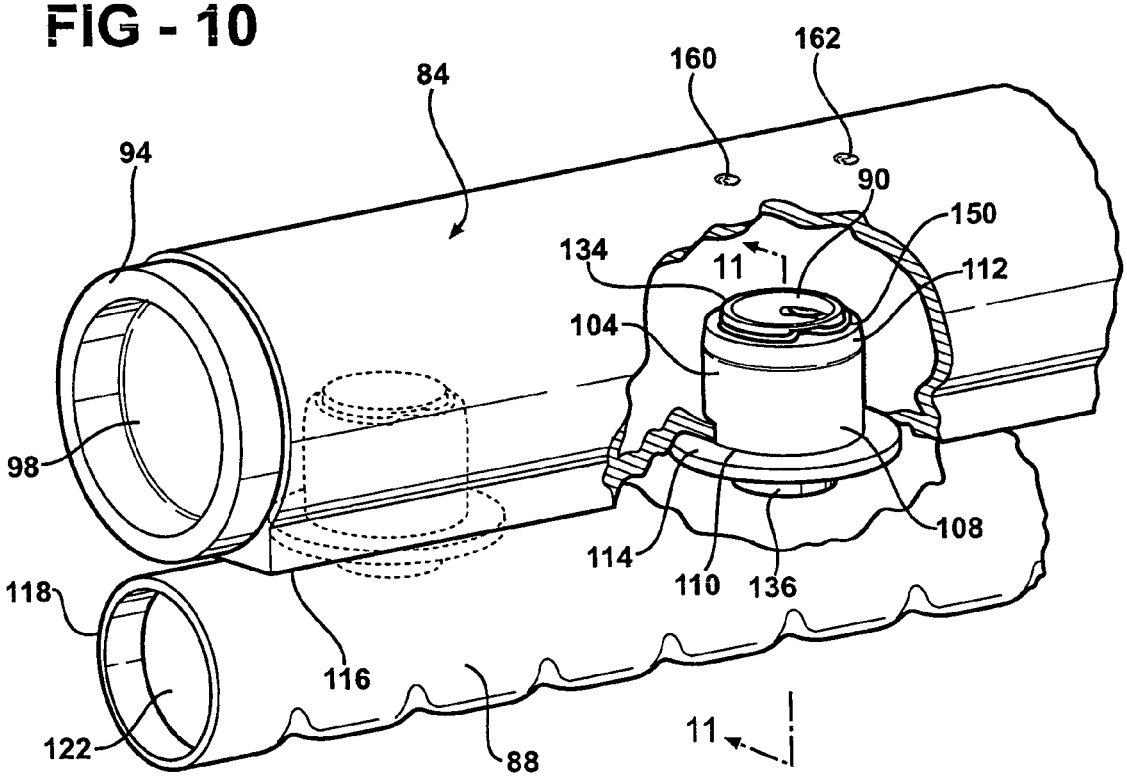
FIG. 10 is a perspective fragmental and partially broken view of the alternative embodiment of the receiver member shown in FIG. 9.
Figure 11:
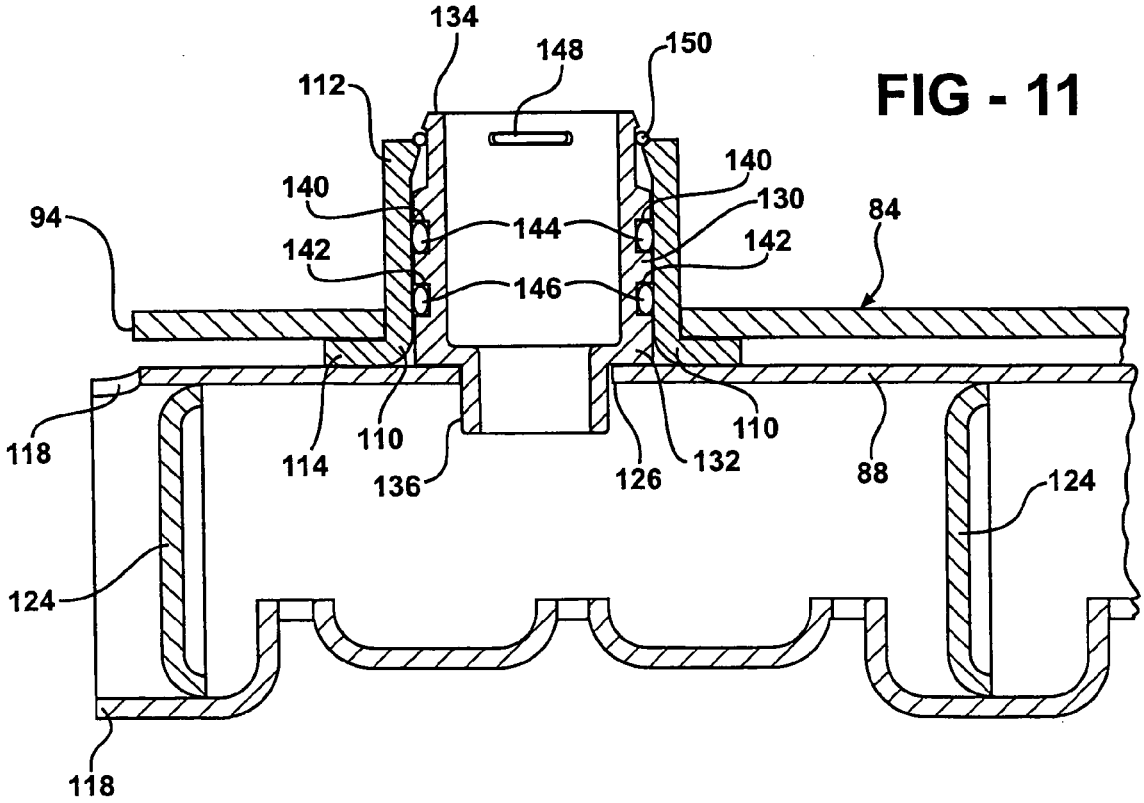
FIG. 11 is a cross sectional fragmental view of the alternative embodiment of the receiver member shown in FIG. 9.
Figure 12:
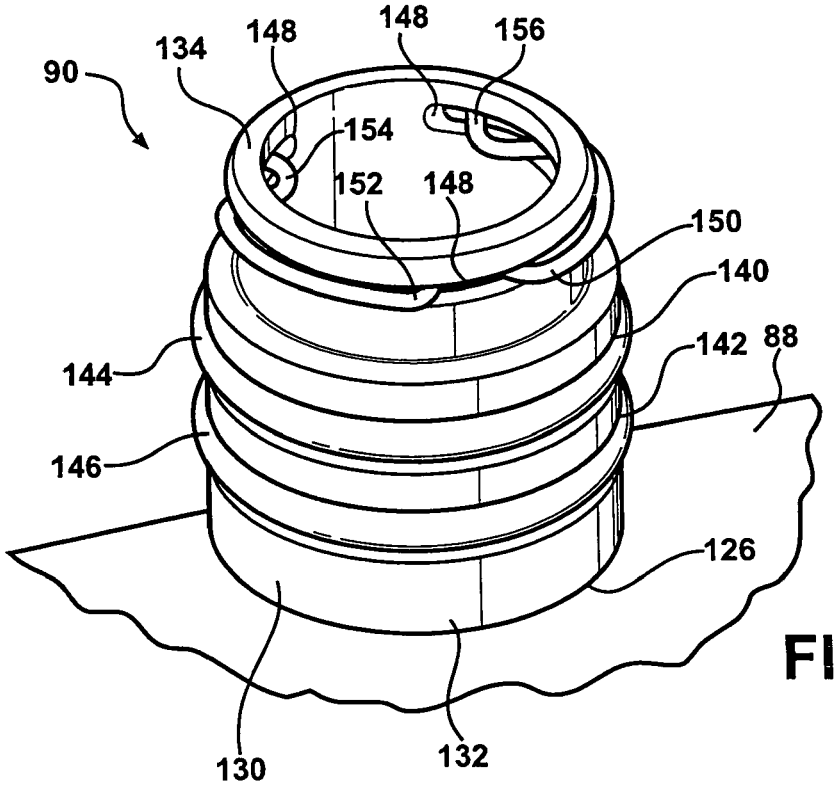
FIG. 12 is a perspective partial view of the male coupler of the alternative embodiment of the receiver member shown in FIG. 9.
Figure 13:
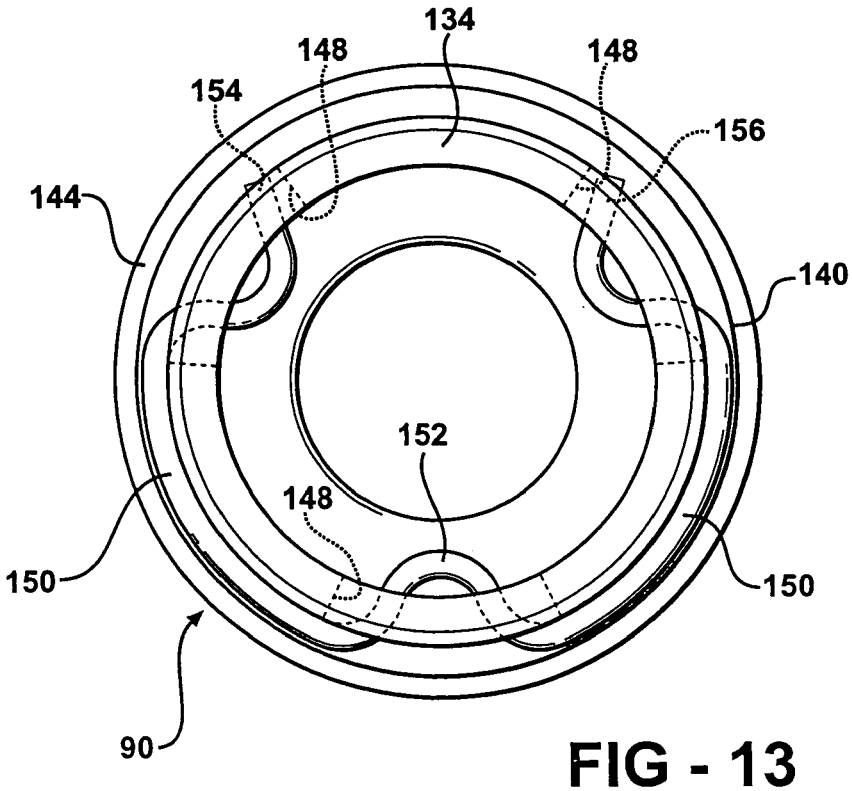
FIG. 13 is a top view of the male coupler shown in FIG. 12.

The receiver member 84 includes at least one coupler 104 that extends into the receiver member 84 between the opening 86 and the male coupler 90 to mechanically engage the male coupler 90 with the opening 86 to form a seal between the male coupler 90 and the opening 86 surfaces and to prevent leakage of the refrigerant. In addition, the coupler 104 is also used for preserving pressure 106 inside the receiver member 84. The coupler 104 has a body 108 including first and second terminal ends 110, 112. The body 108 of the coupler 104 includes tubular configuration, i.e. circular configuration. The coupler 104 further includes a collar 114 integral with and extending perpendicularly to the alignment axis A from the first terminal end 110. The collar 114 has a surface complimentary to the configuration of the receiver member 84. If, for example, the receiver member 84 includes a circular configuration, the collar 114 may present a convex configuration to complement with and extend along the circular configuration of the receiver member 84. Alternatively, if, for example, the receiver member 84 presents a partially circular configuration with a flat bottom 116, as shown in FIG. 7, the collar 114 may present a flat configuration to complement with and extend along the flat bottom 116 of the receiver member 84. The coupler 104 is mechanically connected with the receiver member 84, wherein the body 108 of the coupler 104 extends substantially thereupon. The couplers 104 are welded, clinched to the receiver member 84, or are attached thereto by other methods known in the art.

The tubular member 88 includes first and second terminal ends 118, 120 and is operably and fluidly connected with other terminal ends 48 of the tubes 44. The first 118 and second 120 terminal ends of the tubular member 88 are covered with caps 122, 124, respectively. The caps 122, 124 of the tubular member 88 are formed into the circular shape, complementary to the circular configuration of the tubular member 88, by press working an aluminum or aluminum alloy plate. The tubular member 88 includes at least one separator wall 124 aligned with the separator wall 74 of the header tank 40. The tubular member 88 includes openings 126, defined therein and spaced one from the other. The openings 126 receive the male couplers 90 therein and are aligned with the complementary couplers 104 embedded in the receiver member 84.

The male couplers 90 are spaced one from the other and aligned with respect to the couplers 104 of the receiver member 84 along the alignment axis A. Each male coupler 90 includes a body 130 having terminal ends 132, 134. The male coupler 90 includes a neck 136 of a smaller diameter than the diameter of the body 130. The neck 136 of each male coupler 90 is disposed into the opening 126, defined in the tubular member 88. The male coupler 90 is clinched with the tubular member 88. The male coupler 90 has the diameter smaller than the diameter of the coupler 104. The coupler 104 and male coupler 90 are connected one with the other by an aluminum braze for fuseably connecting the coupler 104 with the male coupler 90.

As appreciated by those skilled in the art, the aforementioned aluminum braze or brazing involves joining of components, such as, for example, the coupler 104 and the male coupler 90, or, for example, the core assembly 34 and the header tank 40. For example, the male coupler 90 is prefabricated by having a brazing alloy (cladding) layer, i.e. outer layer (not shown) whose melting point is appreciably lower than that of the parent material (base alloy) base material of the male coupler 90. The cladding is typically placed adjacent to or in between the components to be joined, like the coupler 104 and the male coupler 90, whereby the receiver member 84 is heated to a temperature where the cladding material melts and the parent material does not. Either the inner surface of the coupler 104 or the outer surface of the male coupler 90 could include the cladding material. Upon cooling, the cladding forms a metallurgical bond between the joining surfaces of the components, i.e. the coupler 104 and the male coupler 90. The brazing process occurs in a furnace (not shown).

In automotive heat exchanger applications, the cladding is supplied via a thin sheet on the base alloy, as the aforementioned male coupler 90 presents. The base alloy provides the structural integrity while the low melting point cladding melts to form the brazed joints. The core assembly 34, the header tank 40, the receiver member 84 and the tubular member 88 with the respective couplers 104 and male couplers 90, connected thereto, are formed from aluminum, aluminum alloy, and the like, and are integrally brazed in the furnace to provide the condenser 24 having high corrosion resistance and high heat conductivity characteristics.

The receiver member 84 includes an alternative embodiment shown in FIGS. 9 through 13. In the alternative embodiment, the male coupler 90 includes a pair of annular grooves 140, 142 defined in the body 130 of the male coupler 90. The male coupler 90 includes a pair of O-rings 144, 146 disposed annularly in the respective annular grooves 140, 142. The male coupler 90 includes a plurality of annular slots 148 spaced one from the other and defined at the other terminal end 112 of the male coupler 90. A snap-in member 150 has disposed about the male coupler 90 includes central 152 and terminal 154, 156 convex portions. The central 152 and terminal 154, 156 convex portions are slidably disposed in the respective annular slots 148. When the male coupler 90 is slidably inserted into the coupler 104 of the receiver member 84, the snap-in member 150 contracts to the center of the male coupler 90 due to the frictional contact with the coupler 104. When the male coupler 90 extended substantially into the coupler 104, the snap-in member 150 is released from the contracting stage, thereby engaging the terminal end of the coupler 104 to prevent the male coupler 90 from retracting rearwardly and away from locking engagement with the coupler 104.

In the alternative embodiment of the present invention, the tubular member 88 of the receiver member 84 is brazed with the core assembly 34 and the header tank 40 separately from the receiver member 84. The O-rings 144, 146 are placed into the respective annular grooves 140, 142 of the male couplers 90 after brazing in the furnace is complete. The receiver member 84 includes a pair of depressions 160, 162, shown in FIG. 10, defined therein and oriented above the terminal convex portions 154, 156. The depressions 160, 162, however, may be defined on the side wall of the receiver member 84 or at the terminal ends 94, 96 and oriented with respect to the terminal convex portions 154, 156.

During the service of the condenser 24, the depressions 160, 162 are opened via drilling, or the like, to receive a fork-type screw driver or tool (not shown), to engage and force the terminal convex portions 154, 156 of the snap-in member 150 to the center of the male coupler 90 to release the male coupler 90 from locking engagement with the coupler 104 of the receiver member 84. This design provides the condenser 24 with the receiver member 84 that allows a technician to engage and disengage the condenser 24 and the receiver member 84 for servicing and replacing the receiver member 84 without destroying the condenser 24. In addition, the receiver member 84 with the drilled depressions 160, 162 may prevent a non-technician from trying to re-install the receiver member 84 thereby preventing possible injuries to the non-technician caused by the refrigerant.

A method of forming the condenser 24 for the air conditioning system includes the step of connecting the header tank 40 to the core assembly 34 at the terminal end 38 of the core assembly 34 and the tubular member 88 to another terminal end 36 to condense the refrigerant flowing internally. The next step of the method includes connecting the receiver member 84 to the tubular member 88 of the core assembly 34 parallel to the header tank 40. This step includes disposing at least one male coupler 90 extending from the tubular member 88 into the opening 86 defined in the receiver member 84 to mate the male coupler 90 with the opening 86.

The method further includes disposing at least one coupler 104 into the receiver member 84 between the opening 86 and the male coupler 90 thereby connecting the coupler 104 with the receiver member 84 followed by mechanically engaging the coupler 104 with the male coupler 90 to form the seal between the male coupler 90 and the opening 86 to prevent leakage of the refrigerant and to preserve pressure inside the receiver member 84. The step of disposing the coupler 104 is further defined as disposing the body 108 of the coupler 104 into the opening 86. The step of disposing the coupler 104 further includes disposing the collar 114 of the coupler 104 onto the receiver member 84 about the opening 86, followed by brazing the coupler 104 with the receiver member 84, and brazing the coupler 104 with the male coupler 90. The next step of the method includes brazing the condenser 24 in the furnace.

Alternatively, the step of disposing the coupler 104 with the male coupler 90 includes forming the annular grooves 140, 142 in the male coupler 90, followed by the step of forming the annular slots 148, spaced the one from the other. When the annular grooves 140, 142 and the slots 148 are formed, the following step of the method includes disposing the snap-in member 150 into the annular slots 148. The O-rings 144, 146 are further disposed about the annular grooves 140, 142, respectively. The method includes the step of snapping the male couplers 90 into the respective couplers 104.

The receiver member 84 and the couplers 104, disposed and clinched therein, are brazed separately from the core assembly 34 operatively connected to the header tank 40 and the tubular member 88 having the male couplers 90 connected thereto. The separate brazing is required due to the different melting temperatures of the condenser 24 components and the O-rings 144, 146.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A condenser for an air conditioning system, comprising:

a core assembly having first and second terminal ends for condensing a refrigerant flowing between said first and second terminal ends;

a header tank operably connected to said first terminal end;

a tubular member presenting at least one male portion and operably connected to said second terminal end;

a receiver member presenting at least one female portion defining an alignment axis for mating with said male portion along said alignment axis; and a coupler extending into said receiver member and disposed between said female and male portions to engage said male portion with said female portion for forming a seal between said male and female portions to prevent leakage of the refrigerant and for preserving pressure inside said receiver member.

2. A condenser for an air conditioning system as set forth in claim 1 wherein said coupler includes a body having first and second terminal ends.

3. A condenser for an air conditioning system as set forth in claim 2 wherein said body presents a tubular configuration.

4. A condenser for an air conditioning system as set forth in claim 3 wherein said tubular configuration of said body presents a circular configuration.

5. A condenser for an air conditioning system as set forth in claim 3 wherein said coupler further includes a collar integral with and extending perpendicularly to said alignment axis from said first terminal end.

6. A condenser for an air conditioning system as set forth in claim 5 wherein said collar has a surface complimentary to the surface of said receiver member.

7. A condenser for an air conditioning system as set forth in claim 1 wherein said female portion is defined by an opening in said receiver member.

8. A condenser for an air conditioning system as set forth in claim 7 wherein said male portion has a tubular configuration.

9. A condenser for an air conditioning system as set forth in claim 8 wherein said male portion includes a body having terminal ends.

10. A condenser for an air conditioning system as set forth in claim 9 wherein said male portion includes a neck having a diameter smaller than a diameter of said body.

11. A condenser for an air conditioning system as set forth in claim 10 wherein said male portion is mechanically connected to said tubular member.

12. A condenser for an air conditioning system as set forth in claim 11 wherein said body has the diameter smaller than a diameter of said coupler.

13. A condenser for an air conditioning system as set forth in claim 12 wherein said coupler and said male portion are connected and sealed one with the other by a braze solution for fuseably connecting said coupler with said male portion.

14. A condenser for an air conditioning system as set forth in claim 1 wherein said male portion includes a pair of annular grooves defined in said male portion.

15. A condenser for an air conditioning system as set forth in claim 14 wherein said male portion includes a pair of O-rings disposed annularly in the respective annular grooves.

16. A condenser for an air conditioning system as set forth in claim 15 wherein said male portion includes a plurality of annular slots spaced one from the other and defined in said male portion.

17. A condenser for an air conditioning system as set forth in claim 16 including a snap-in member having central and terminal convex portions.

18. A condenser for an air conditioning system as set forth in claim 17 wherein said central and terminal convex portions are slidably disposed in the respective annular slots.

19. A condenser for an air conditioning system as set forth in claim 18 wherein said receiver member includes a pair of depressions defined therein and oriented above said terminal convex portions with said depressions pierced for receiving a tool to engage and force said terminal convex portions to said alignment axis to release said male coupler from locking engagement with said coupler for replacing said receiver member having pierced depressions.

20. A condenser for an air conditioning system as set forth in claim 19 wherein said tubular member is operably connected with said core assembly.

* * * * *